US010721573B2

(12) United States Patent
Peters et al.

(10) Patent No.: US 10,721,573 B2
(45) Date of Patent: Jul. 21, 2020

(54) NON SURGICAL BONE ANCHORED HEARING SYSTEM WITH IMPROVED VIBRATION TRANSFER

(71) Applicant: Oticon Medical A/S, Smørum (DK)

(72) Inventors: Hanna Peters, Askim (SE); Magdalena Eriksson, Askim (SE); Hanna Stenhamre, Torslanda (SE); Marianne Philipsson, Smørum (DK); Christina Wassard, Smørum (DK); Bengt Bern, Askim (SE)

(73) Assignee: OTICON MEDICAL A/S, Smørum (DK)

( * ) Notice: Subject to any disclaimer, the term of this patent is extended or adjusted under 35 U.S.C. 154(b) by 0 days.

(21) Appl. No.: 16/288,654

(22) Filed: Feb. 28, 2019

(65) Prior Publication Data

US 2019/0273995 A1 Sep. 5, 2019

(30) Foreign Application Priority Data

Mar. 1, 2018 (EP) ..... 18159384

(51) Int. Cl.

| | |
|---|---|
| ***H04R 25/00*** | (2006.01) |
| *H04R 1/10* | (2006.01) |
| *H04R 1/46* | (2006.01) |

(52) U.S. Cl.

CPC ..... *H04R 25/606* (2013.01); *H04R 25/70* (2013.01); *H04R 1/1075* (2013.01); *H04R 1/46* (2013.01); *H04R 25/554* (2013.01); *H04R 25/60* (2013.01); *H04R 2225/021* (2013.01); *H04R 2225/0213* (2019.05); *H04R 2460/13* (2013.01)

(58) Field of Classification Search

CPC ..... H04R 1/46; H04R 1/1075; H04R 25/60; H04R 25/70; H04R 25/554; H04R 25/606; H04R 2225/021; H04R 2460/13

See application file for complete search history.

(56) References Cited

U.S. PATENT DOCUMENTS

2012/0294466 A1* 11/2012 Kristo ..... H04R 25/606 381/322
2013/0089229 A1 4/2013 Kristo et al.
2015/0063616 A1 3/2015 Westerkull

FOREIGN PATENT DOCUMENTS

JP 2011-087142 A 4/2011

* cited by examiner

*Primary Examiner* — Brian Ensey

(74) *Attorney, Agent, or Firm* — Birch, Stewart, Kolasch & Birch, LLP

(57) ABSTRACT

The disclosure relates to a plate structure of a non-surgical bone conductive device, configured to be attached to a part of the skin of the skull of a hearing impaired person. The non-surgical bone conductive device is designed such that an optimized vibration transfer is achieved, while at the same time allowing a sufficient leverage of the weight of the sound processor when the sound processor is connected to the plate structure.

19 Claims, 12 Drawing Sheets

NON SURGICAL BONE ANCHORED HEARING SYSTEM WITH IMPROVED VIBRATION TRANSFER

FIELD

The present disclosure relates to a non-surgical bone anchored device, also denoted a non-surgical bone conductive device, configured to be arranged on the skull of a hearing impaired person, so as to transmit sound received from the surroundings into the auditory path of the hearing impaired. The sound is transmitted as vibrational energy transferred through the skull of a user via bone structure into the auditory path. More particularly, the disclosure relates to a connector plate of a non-surgical bone conductive hearing aid solution, wherein the non-surgical bone conductive hearing aid solution is optimized in view of providing an improved and efficient vibration transfer to the skull bone of a hearing impaired person.

BACKGROUND

The human auditory path consists of the external ear, the middle ear and the inner ear. In the external ear, sound transmitted from the environment of a human, is collected and transmitted to the tympanic membrane. Sound waves imparting onto the tympanic membrane causes the tympanic membrane to vibrate, whereby sound is transmitted into the middle ear. In the middle ear, the transmitted vibrations are forcing structures of the middle ear, i.e. the stapes, malleus and incus to vibrate, which causes the oval window to vibrate. The vibrations of the oval window are transmitted as energy into the inner ear, where the basilar membrane starts to move causing excitement of nerve cells of the human auditory path.

Hearing impairment may arise in any of the previous mentioned parts of the human auditory path, and in dependency of the place of damage to the auditory path, a hearing loss can be classified as conductive, sensorineural or a mixed hearing loss, which is a combination of a conductive and a sensorineural hearing loss. The most common type of hearing loss is caused by problems with the inner ear or nerve pathways. Although sound transmission through the outer and middle ear to the inner ear may be normal, the information cannot be coded into electrical signals that the brain can use. People with this type of hearing loss may benefit from a hearing aid or a cochlear implant system. A Conductive hearing loss is caused by a blockage of sound transmission through the outer ear and/or middle ear. This can occur due to conditions such as chronic otitis media, otosclerosis (calcification that reduces the mobility of the stapes), malformations of the outer ear or e.g. a perforated eardrum. Conductive hearing loss can be treated in many ways, including using bone anchored hearing systems. The last type of hearing loss is the mixed hearing loss. A mixed hearing loss may arise due to e.g. a chronic infection which affects the auditory pathway, such that the cochlear does not function properly. Such mixed hearing loss may be treated by for example using bone anchored hearing systems.

This disclosure generally relates to bone anchored hearing systems which are designed to use the human body's natural ability to transfer sound through vibration to the inner ear. In a bone conducting system, such as a bone anchored system and/or a non-surgical bone conductive system, the external and middle ear is bypassed, applying a device which transmits vibrations directly into the inner ear. The bone conductive system converts environmental sounds into vibrations, which are transmitted through the skull of a hearing impaired and into the inner ear.

The first bone conductive systems generally consisted of a small titanium implant placed in the bone behind the ear of a hearing impaired. A sound processor that attaches to the implant via the skull of a hearing impaired ensured that sounds could be converted into vibrations, which are transmitted through the implant to the skull bone and into the inner ear. These implanted bone anchoring systems have proven to be very good in transferring vibrations directly into the inner ear, but has the drawback of requiring surgery, which patients that would benefit from a bone anchored hearing solution is often not inclined to undergo in view of improving their hearing.

Accordingly, non-surgical bone conductive hearing solutions have been considered as an alternative. The non-surgical bone conductive hearing solutions generally have the same function as the surgical implants. The most commonly used non-surgical solutions generally comprises a soft band or a head band which attaches the sound processor to the skull of a user allowing vibrational transfer of energy into the auditory path. Additional developments of such systems, has focused on getting rid of the head band and instead apply a more simple patch which is connected to the skin of a skull of a hearing impaired person, and made from a material allowing the patch to transfer a vibrational force to the bone skull. Such patch may comprise an adhesive layer on one side, which adhesive layer is configured to attach a side of the patch to the skin of the skull of the hearing impaired person. On the other opposing side to the adhesive layer, the patch comprises a fixture to which a sound processor device of the bone conductive device is attached. The sound processor is generally build into a device which comprises the signal processing means configured for receiving an acoustic sound signal and transmit said signal via a signal processor to a vibration transferred to the skull of a human person.

The design of bone-anchored/conductive hearing solutions (both surgical and non-surgical system) is continuously optimized in view of improving the vibration transfer to the recipient's skull, but also to create a system which is discreet and cosmetically appealing for the hearing impaired to wear. Especially for non-surgical bone conductive solutions, the distribution of the weight of the signal processor when connected to the patch is important, since the implant part is dispensed with, and the device is merely connected to the surface of the skin of the head of a hearing impaired by a headband holding the device in place and or by e.g an adhesive. Accordingly, it is important that the non-surgical bone conductive solutions can be kept tightly to the skin of a user without falling off due to the weight of the signal processor of the device, while providing a sufficient vibration transfer.

Additional considerations which are to taken into account in the design of non-surgical bone conductive solutions includes minimization of feedback and breathability of the device.

Accordingly, this disclosures aims at providing a non-surgical bone conductive hearing solution that addresses at least some of the above-mentioned considerations for designing an efficient and appealing non-surgical bone conductive device. At least the present disclosure provides an alternative to the non-surgical bone conductive technology, which improves the vibrational transfer, stability and breathability of the device when mounted to the skin of a skull of a hearing impaired user.

SUMMARY

Accordingly, the disclosure according to embodiments described herein discloses a connector of a bone conductive hearing system, configured to be attached to a part of the skin of the skull of a hearing impaired person. The connector comprises a plate structure having a first side provided with an abutment protruding from the first side and being configured to be detachably attached to a sound processor of a bone conducting system, and a second side opposing the first side. The second side of the plate structure is provided with a protrusion, which protrusion is configured to protrude from a surface of the second side in a direction away from the abutment, wherein the protrusion is configured to abut the skin of a skull when the plate structure is attached to the skin.

Accordingly the connector plate is substantially configured as a plate structure, which are provided with an abutment on one side and a protrusion on a second opposite site. The protrusion is configured to touch the skin of the hearing impaired persons' skull, thereby allowing at least a point of the plate structure to be in constant contact with the skin of a user, ensuring a constant vibration transfer. The plate structure according to the disclosure ensures that a constant and direct contact between the skin and the plate structure is achieved, whereby the vibrational transfer is optimized, via the protrusion of the plate structure. It should be noted that the better contact between the skin and the plate structure, the more efficient vibration of sound energy is ensured. Therefore, this solution overcomes at least some of the problems of known non-surgical solutions, where the sound processor transfers vibrational energy through a structure which is held onto the head by us of e.g. a headband. Such solution does not necessarily apply a constant pressure towards the skin of the user, and a risk of not providing a constant vibration transfer is high. Thus, the protrusion of the plate structure, solves the problems by ensuring a constant and direct pressure to the skin of a user, when the plate structure is attached to the head thereof.

Accordingly, for attaching the plate structure to the skin of a user, the connector may comprise and adhesive pad, which are attached to the plate structure. Thus, the plate structure may be configured to connect with an adhesive pad, where the adhesive pad is configured to cover the second of the plate structure, thereby allowing the plate structure to be adhesively attached to the skin of a user.

To ensure an efficient vibration transfer and an optimized design, the at least one protrusion may form an integrated part of the plate structure. Thus, the plate structure is formed with the protrusion as a single part, which are subsequently connected with an adhesive. In this way it ensured that the protrusion cannot be removed or detached from the plate structure, in order to ensure the vibration transfer, via a constant contact point of contact between the plate structure and the skin.

In general, the protrusion ensures less dampening of the vibrations, since the protrusion provides a constant pressure to the skin, which ensures that the vibrations are more efficiently transferred with a minimized dampening thereof. Accordingly, providing the plate structure with the protrusion described herein ensures less dampening effect of the vibrations which result in better perceived sound by the hearing impaired.

The vibrational energy transfer improvement are especially optimized by providing in at least one embodiment, a protrusion which is centrally arranged with respect to the abutment. By "centrally arranged" it should be understood that the protrusion and the abutment shares a common center point, through which an axis may be drawn. In other words, it may be understood that the center point of the protrusion is substantially aligned with a center point of the abutment. This ensures that the vibration energy transferred through the abutment (due to the connection with the sound processor at this point) will efficiently be transferred directly to the protrusion, form where the vibrations are transferred directly to the skin through the protrusion. A top point of the protrusion may always be in contact with the skin, and ensures that the direct transfer of vibrations is achieved. The protrusion and the abutment may together define a body portion of the plate structure, which body portion should be understood to be defined as a portion of the plate structure, where at least the protrusion and/or the abutment is arranged.

In order to ensure an even better vibration transfer, the protrusion may be formed in a substantially rigid material. Accordingly, the plate structure and the protrusion may be formed in the same material. At least the protrusion is provided with a hardness which ensures an optimized vibration transfer.

In order to ensure that the plate structure can be efficiently connected to the skin of the head of a hearing impaired, the plate structure comprises an adhesive pad. Thus, the connector plate, may comprise the plate structure and the adhesive pad, attached thereto. The adhesive pad may comprise one or more carrier layers and at least one adhesive layer, wherein the one or more carrier layers may be provided with an opening, wherein the protrusion extends through the opening.

Accordingly, in an embodiment, the protrusion is not covered by any layers. At least at a top point of the protrusion, the protrusion is not covered by any carrier or adhesive layers. This ensures that a direct contact between the substantially hard or rigid material of the protrusion and the skin of the skull bone of the user is achieved, thereby allowing a vibrational transfer which is not exposed to dampening effects arising if any carrier layers were present. Accordingly, a more efficient vibrations transfer may be achieved, which results in an improved sound perceived by the hearing impaired person. If the protrusion is to be covered by an adhesive layer, which is also a possibility, then a material which is non compressible would be needed. That is, the rigidity of the material should be maintained, since it is the rigidity of the protrusion, which ensures that a vibration may be transferred efficiently.

It should be noted that the opening in the layers of the adhesive pad, through which the protrusion extends, aid in ensuring that breathability of the device is obtained. That is, the protrusion will when mounted to the skin of a user create air pockets in the corners protruding through the adhesive pad, thereby allowing breathability of the device. This is due to the fact that the plate structure at the site of the protrusion will not align fully with the contour of the skin of a user, whereby small air pockets are created, which allows the device to "breathe".

In an embodiment, the plate structure comprises a body portion as previously described, in which body portion the protrusion and the abutment is arranged. The body portion may be defined as a center point of the plate structure which is substantially in the middle of the plate structure when measured from a top part to a bottom part of the plate structure. By providing a body portion, wherein at least one of the protrusion and/or the abutment is arranged it is ensured that the connector plate can be designed such that the weight distribution when having the sound processor of the bone conductive device connected thereto is optimized.

Accordingly, by substantially centering the abutment and/or the protrusion together, the plate structure may be designed with one or more "legs or fingers" extending radially outwards from the body portion, wherein at least the abutment is arranged centrally in the body portion. In this way, the "legs or fingers" may assist in ensuring that the weight is distributed onto a larger area of the skin of the user, when the plate structure is attached to skin, so as to ensure that the connector plate does not loosen from the skin due to the weight of the sound processor.

It should be noted that the above mentioned body portion could be arranged in a more lower part or in a more upper part of the plate structure. Thus, it should be contemplated that the plate structure comprises a top and a bottom defining a substantially longitudinal direction of said plate structure. Thus, different embodiments, having the body portion arranged differently on the plate structure will be described throughout the disclosure, and will be more clearly described in the detailed description of the figures.

In one embodiment, the protrusion and the abutment are arranged centrally with respect to each other in the top part of the plate structure, so as to define the body portion wherein a first set of one or more legs extends from the body portion towards a bottom portion, where the extension of the first set of one or more legs defines the bottom part of the plate structure. Accordingly, the lengths of the one or more legs may define the bottom region of the plate structure, in that the longest leg of the first set of legs defines the bottom of the plate structure. By providing a body portion, which comprises the abutment and/or the protrusion and is arranged more towards the top of the plate structure, it is ensured that the legs extending from the body portion, can take on the leverage provided by the having the sound processor connected to the plate structure through the abutment. These leg extensions assist in creating the needed leverage arms for counteracting a force from the sound processor pulling the plate structure of skin of a user, when mounted thereto.

In another embodiment, however, the body portion, may be configured more central on the connector plate. That is, in an embodiment, the plate structure may comprise a second set of legs extending from the body portion in an opposite direction to the first set of legs, wherein the second set of legs is substantially shorter than said first set of legs. In this way it is ensured that the leverage of the sound processor, when this is connected to the plate structure, is distribution onto at least the substantially longer legs of the plate structure, while the second set of legs arranged in the top of the plate structure together with the longer first set of legs contributes to retain the connector plate to the skin. Furthermore, the leg extension assists in arranging the plate structure more easily in the hairless area behind the ear of a user.

In general, for the above design considerations, it should be noted that the sound processor, when attached to the abutment, will substantially with a long side thereof align with a long length (i.e. top to bottom) of the plate structure. Accordingly, the heavy part of the sound processor causes a downward directed force, why the design of the plate structure should ensure that this downward directed force may be counteracted in order for the plate structure to stay in place on the head. This is achieved by the above mentioned designs of the plate structure, where the legs are acting as leverage arms for the plate structure, ensuring that the plate structure stays in place on the head.

These and further design options which have been considered relevant for this purpose will be elaborated on in the detailed description, where embodiments are described by examples in more detail.

It should similarly be noted that one or more protrusions could be integrated into the plate structure. Accordingly, in an embodiment the plate structure comprises two or more protrusions, wherein a first protrusion is configured as the centrally arranged protrusion with respect to abutment and/or a second and/or third protrusion is arranged in a position being laterally displaced on said plate structure with respect to the abutment. It should be understood that even more protrusions could be considered, and each of the protrusion would provide the plate structure with direct contact points with the skin, which ensures an improved vibrations transfer of the vibrations to the skull bone.

In each of the embodiments having a set of legs or fingers extending from the body portion, it should be understood that the "fingers or legs" are separated and/or combined in such a manner that a space and/or opening is created between the legs or fingers. This space or opening is covered by the adhesive pad, which allows breathability of the device. Thus when the plate structure is mounted to the skin of the device, the skin is allowed to "breathe" through the adhesive via these openings or spaces. Details on the construction of the plate structure in relation to this breathability will be apparent from the detailed description.

Furthermore, and as apparent from the disclosure, the plate structure is in an embodiment connected with a sound processor in order to form a non-surgical bone conductive device, which are intended to compensate for a hearing loss of a hearing impaired person. The non-surgical bone conductive device, as described herein, is designed so that an optimized vibration transfer is achieved, while allowing a discrete design of the device. Especially, the plate structure, is designed, as described herein, such that a protrusion ensures an optimized vibration transfer, while lowering potential feedback and dampening effects, when the bone conductive device is connected to the head of a hearing impaired person.

It should be noted that the front of the plate structure should be understood to be the first side of the plate structure, which is intended to face away from the skin of a user when mounted to the head of a hearing impaired. Accordingly, the back of the plate structure should be understood to be the second side of the plate structure, which faces towards the skin of a user when mounted to the head of a hearing impaired.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

FIGS. 5A to 5B illustrates a plate structure having legs according to an embodiment e, wherein FIG. 5A is a front view of the plate structure and FIG. 5B is a side view;

FIGS. 7A to 7B illustrates an embodiment of a plate structure, wherein FIG. 7A is a front view of said plate structure and FIG. 7B is a side view;

FIG. 8A is a side view of the plate structure, FIG. 8B is a front view of the plate structure and FIG. 8C is a back view of the plate structure;

FIGS. 9A, 9B and 9C illustrates a plate structure of the substantially closed type, wherein the bottom part is configured with a protrusion, wherein FIG. 9A is a side view, FIG. 9B is a front view and FIG. 9C is a back view of the plate structure;

DETAILED DESCRIPTION

Figure 1B:
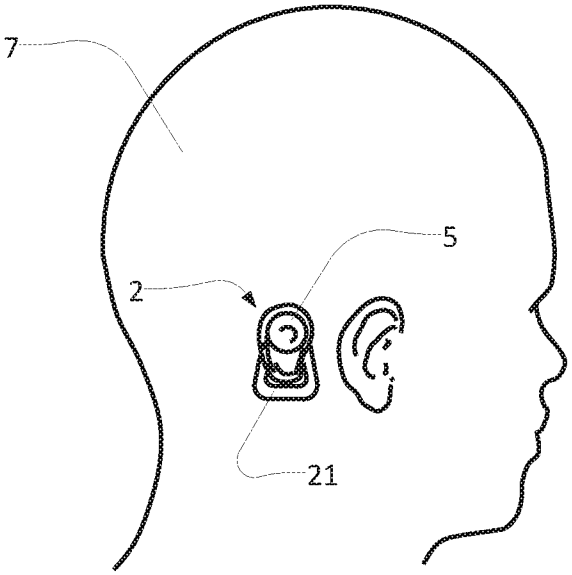
FIG. 1B illustrates the plate structure according to FIG. 1A, where furthermore a a sound processor has been connected to the plate structure, so as to form a non-surgical bone conduction device.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device adapted to receive an audio signal electronically, possibly modifying the audio signal and providing the possibly modified audio signals as an audible signal to at least one of the user's ears. Such audible signals may be provided in the form of an acoustic signal transferred as mechanical vibrations to the user's inner ears through bone structure of the user's head.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefiting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a vibrator for providing vibrations transcutaneous to the skull bone.

Now referring to the Figures of the disclosure, a non-surgical bone conductive device will be described in more detail.

Figure 1A:
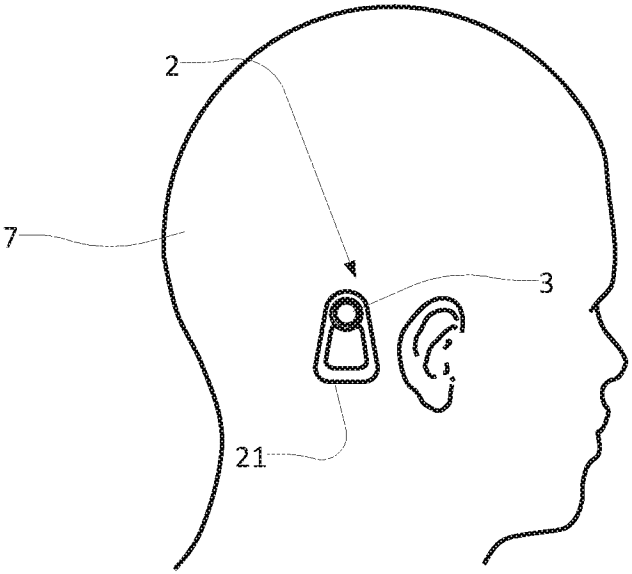
FIG. 1A illustrates the plate structure of the connector of a non-surgical bone conductive device attached to the skin of a hearing impaired person.

Initially with reference to FIG. 1A a human head is illustrated. Onto the head a plate structure 21 according to embodiments of the disclosure is illustrated as an example. The plate structure 21 forms part of a connector 2 of a bone conductive hearing system. As is illustrated, the plate structure 21 is arranged onto the skin 7 of the head of a user, substantially behind the ear of the user. Preferably the plate structure 21 is configured to be arranged in the hairless area behind the ear of the user. Similarly FIG. 1B illustrates a plate structure 21, to which a sound processor 5 is attached. The sound processor 5 allows the connector 2 of the bone conductive hearing system to transfer processed audio signals into the skull bone of the hearing impaired person via the structures on the plate structure 21.

Figure 2B:
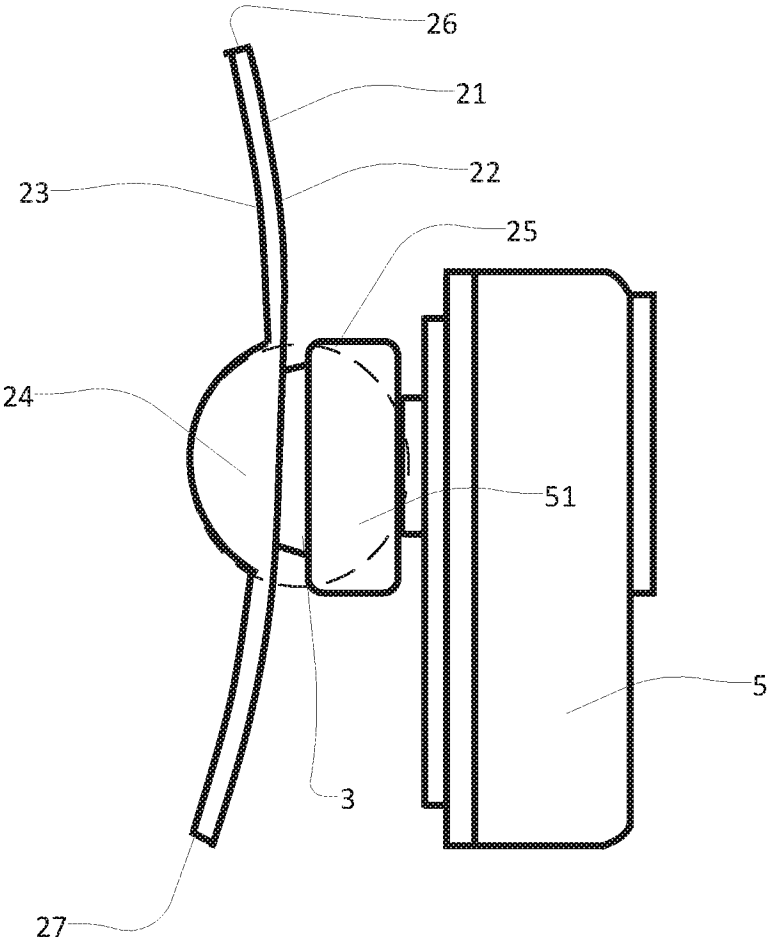
FIG. 2B illustrates a plate structure according to FIG. 2A, wherein a sound processor is connected to the plate structure via the abutment.
Figure 2A:
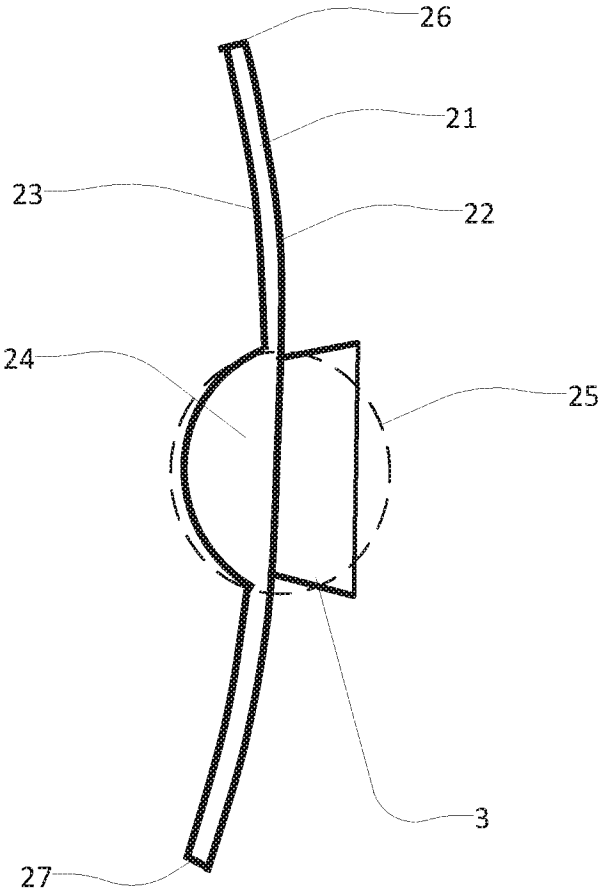
FIG. 2A illustrates a plate structure according to an embodiment, with a protrusion on one side and an abutment on the second side of the plate structure'.

Referring now to FIG. 2A, the plate structure 21 is illustrated in more details. As illustrated in FIG. 2A, the plate structure 21 comprises a first side 22 which faces away from the skin 7 of a user when mounted onto the head, and a second side 23 which faces towards the skin 7 of the head. On the first side 22 (also denoted as the front side) an abutment 3 is forming part of the plate structure 21, which abutment 3 is configured to receive a fixture 51 of the sound processor 5 (see FIG. 2B). It should be noted that the sound processor 5 and the plate structure 21 with their respective elements together form a bone conductive hearing system of the non-surgical type. The plate structure 21 comprises on the second side 23 a protrusion, which is configured to protrude from a surface of the second side 22 in a direction away from the abutment 3. Accordingly, when mounted to the head of a hearing impaired person, the protrusion 24 is configured to abut the skin 7 of the skull of the hearing impaired person. Thus the protrusion 24 enables a constant contact point at the skin 7 of the user along the surface of the plate structure 21.

Preferably, the protrusion is as illustrated in FIG. 2A arranged centrally with the abutment 3 to allow a more direct vibration transfer of sound from the processor to the skull bone of the user. In this way, the abutment and protrusion together defines a body portion 25 of the plate structure 21, from which one or more extensions, such as legs or fingers may protrude, as will become apparent from embodiments described herein.

As is apparent from all of the embodiments illustrated herein, the protrusion 24 preferably forms an integrated part of the plate structure 21, which allow the protrusion to be formed e.g. in the same rigid and/or more rigid material as the plate structure 21. The rigidity of the protrusion optimizes the vibration transfer from the sound processor to the skull bone.

Referring now to FIG. 2B an assembled state of the plate structure 21 and the sound processor 5 is illustrated. Here it is seen how the sound processor 5 is configured to attach to the abutment 3 of the plate structure 21 via the fixture 51. As illustrated in FIG. 2B the sound processor 5 is attached to the place structure 21 at the front side 22 of the plate structure 21 which in a mounted position faces away from the skin 7 of the user. Accordingly, the sound processor 5 which is substantially heavy compared to the plate structure 21 will act on the plate structure 21 with a force potentially dragging the plate structure 21 off the skin 7 of the user, if not having the correct moment arms to counteract such force. Therefore, it is relevant that the sound processor 5 is fixed to the plate structure 21 in such a manner, that the forces are equally distributed onto the surface of the plate structure 21, as illustrated with the force vectors in FIG. 3B. As will become apparent in embodiments described herein, one solution is to attach the sound processor 5 in the center of the plate structure 21, as illustrated in at least FIGS. 2B, 3A and 3B. Other possibilities will become apparent in relation to the other embodiment described herein.

Figure 3B:
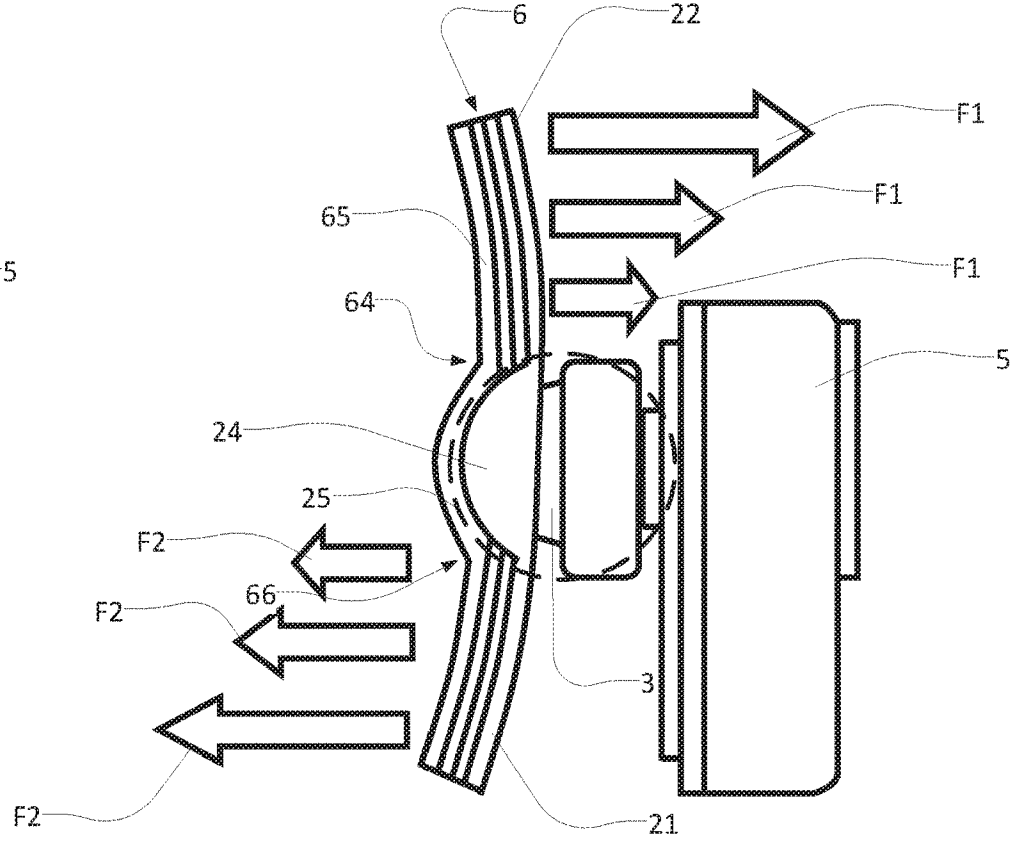
FIGS. 3A and 3B illustrates a plate structure according to FIGS. 2A to 2B, where further an adhesive pad has been attached to the plate structure.
Figure 3A:
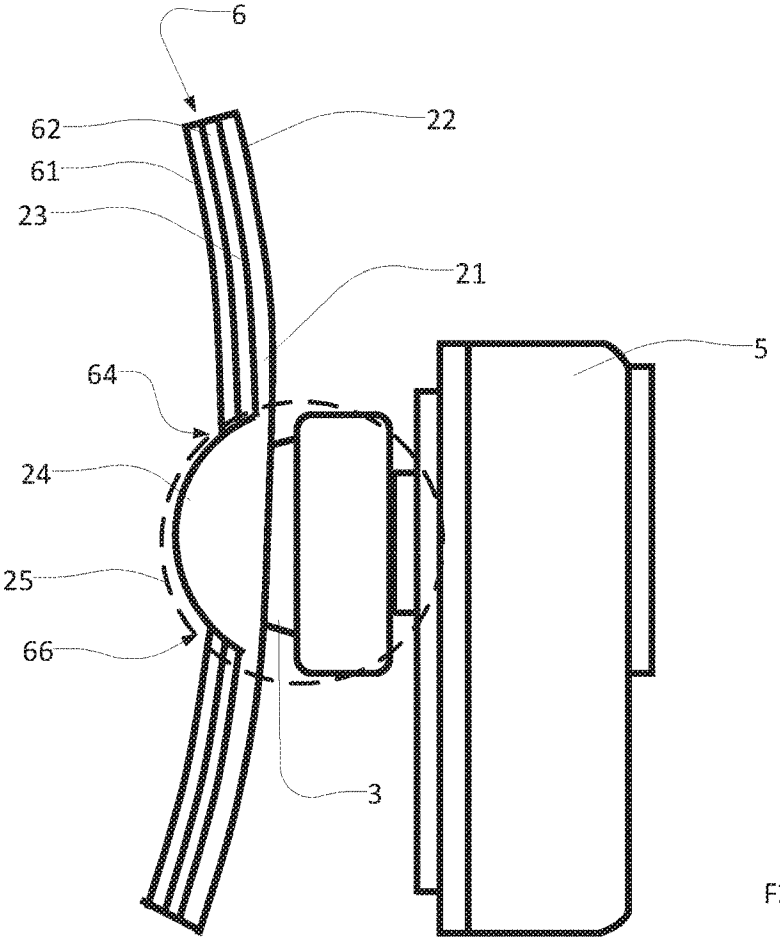

Referring now to FIGS. 3A and 3B, the plate structure 21 is illustrated with the sound processor 5 as previously described. In addition to the previously described embodiments, the plate structure 21 is furthermore illustrated with an adhesive pad 6 attached to the second side 23 of the plate structure 21. As illustrated the adhesive pad is constructed from two layers, configured as an adhesive layer 61 and a carrier layer 62. The layer construction will be elaborated on in further detail in relation to FIGS. 14, 14A to 14 H.

Furthermore, as illustrated in FIG. 3A, the adhesive pad is configured with an opening, wherein the protrusion 24 extends through the opening. In this way the rigidity of the protrusion is not damaged (since none of the softer carrier or adhesive layers covers at least the top of the protrusion). Accordingly, the adhesive layer ensures that the plate structure 21 can adhere to the skin 7 of a user when mounted to the head, where the rigid protrusion 24 abuts the skin, while the remaining of the adhesive pad ensures attachment to the skin. Furthermore, it should be noted that the construction with the protrusion ensures that small air pockets 64, 66 are created at the corner of the protrusion (i.e. the transition between the corner of the protrusion and the surface of the adhesive pad), whereby an improved breathability of the device is obtained.

In an embodiment illustrated in FIG. 3B, the adhesive pad 6 may furthermore be configured with a liner 65, which ensures protection of the adhesive layer prior to mounting the connector to the head of the user. Thus, this liner preferably covers the adhesives layer and also the protrusion. As previously elaborated on the embodiment of FIG. 3B more clearly illustrates how the sound processor more generally is "hanging" on the plate structure 21 via the connection between the fixture 51 and the abutment 3. Accordingly, the sound processor 5 exerts a force onto the plate 21, which are illustrated by force vectors $F_1$ and $F_2$. As is illustrated the sound processor 5 should preferably be connected to the plate structure 21, in such way that an equal force contribution exist on each side of the attachment point of the sound processor 5 to the plate structure 21.

In view of providing a sufficient vibration transfer to the skull bone of the head of the user, the plate structure 21, is as illustrated in the previous described embodiments and Figures provided with a protrusion 24. The protrusion 24 substantially protrudes from the second (back) side 23 of the plate structure 21. Accordingly, the protrusion 24, is configured to abut directly onto the skin 7 of a user, when the plate structure 21 is mounted to the skin via the adhesive pad. In other words the protrusion 24 is configured to touch the skin 7 of a user when mounted to head thereof. The protrusion 24 is preferably formed as an integrated part of the plate structure 21. That means that the protrusion 24 is made as a "one-piece" together with the plate structure 21, and the plate structure 21 and protrusion 24 are not configured to be separated or demounted from each other.

Therefore, the plate structure 21 and the protrusion 24 may be made in the same material, or configured in a production step thereof in two different materials, which are integrated together to provide a final plate structure 21, where the protrusion 24 extends from a surface of the plate structure 21 at the back side 23 thereof. In general, the protrusion 24 of the plate structure 21 ensures that an improved and constant pressure to the skin 7 along the surface of the plate structure 21 is achieved. This ensures a constant vibration transfer to the skin in at least one point of the plate structure 2, namely at the point (and/or surface area) of which the protrusion 24 touches the skin 7.

The length of the plate structure 21 should be understood to be defined as the distance between a top 26 of the plate structure 21 and a bottom 27 of the plate structure 21, where the top 26 in a mounted condition of the plate 2 structure faces towards the top of the head of the hearing impaired and the bottom 27 faces towards the neck part of the hearing impaired person.

As previously mentioned, the abutment 3 and the protrusion 24 is preferably arranged on the plate structure so as to be centrally arranged in relation to each other, since this allow the most direct vibration transfer from the sound processor directly through the fixture, the abutment and the protrusion. Thus, in at least some of the embodiments, the protrusion and the abutment together defines a body portion, from which further structures or elements extends so as to define structures of the plate structure 21. This body portion will in the following be denoted by reference numeral 25, and it should be noted that is does not necessarily needs to be centered in the plate structure along a longitudinal direction from top till bottom thereof. However, as will become apparent, the body portion may be configured to be placed a little towards the bottom or top depending on the specific construction and leverage needed.

As will become apparent in the following description of different embodiments of the plate structure, the protrusion 24 may be positioned in different positions along the length of the plate structure. Furthermore, the plate structure 21 may comprise more than one protrusion 24, 24', 24".

Additionally, the following description of embodiments of the plate structure, will make it apparent, that the construction of the adhesive layer, carrier layers and the arrangement thereof in relation to the plate structure and the abutment may differ among different embodiments.

With regards to the arrangement of the protrusion 24, the following will describe different examples, where one or more protrusions are integrated with the plate structure 21. Accordingly, FIGS. 4A to 4E illustrates different embodiments of a plate structure 21 having one or more integrated protrusions 24, 24', 24". All of the embodiments illustrated in FIGS. 4A to 4E generally comprises a plate structure 21 with a top 26 and a bottom 27, an abutment 3 on the front side 22 and at least one protrusion 24, 24', 24". Accordingly, in the following, only the differences between the different embodiments, will be elaborated on in more detail.

Figure 4A:
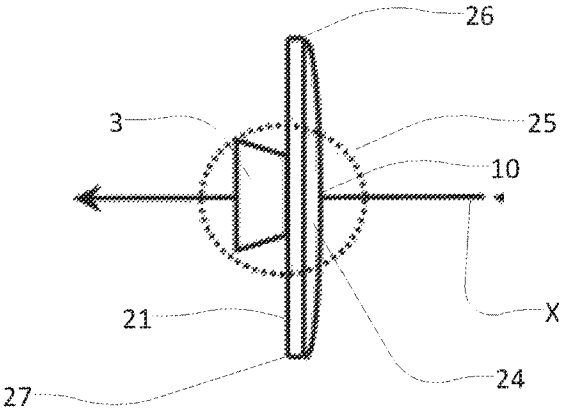
FIGS. 4A to 4E illustrates different embodiments of a plate structure according to the disclosure, wherein the integrated protrusion or protrusions are arranged in different places on the plate structure.

Initially referring to FIG. 4A, a plate structure 21 comprising a single protrusion 24 is illustrated. In this embodiment the protrusion 24 is configured as a convex surface of the plate structure 21. That is, the protrusion 24 substantially covers the surface of the plate structure 21 along the length thereof. Accordingly, the protrusion 24 has a surface extending from a top 26 of the plate structure 21 to the bottom 27 of the plate structure 21 in a convex fashion, so that top point 10 is substantially located in the body portion 25 of the plate structure 2. In other words, the top point 10 of the convex surface of the protrusion 24, may also be configured so that the abutment 3 substantially shares a center point with the top point 10 of the protrusion 24. That substantially means that the protrusion and the abutment share a center point substantially having the same center as, as illustrated by the center axis X in FIG. 4A.

In other words, the protrusion is substantially centrally arranged around a center point of the abutment 3. Accordingly, when mounted to the skin of a user, it is ensured that at least the top point 10 of the convex surface will always be in contact with the skin of a user, allowing an efficient vibration transfer.

Figure 4B:
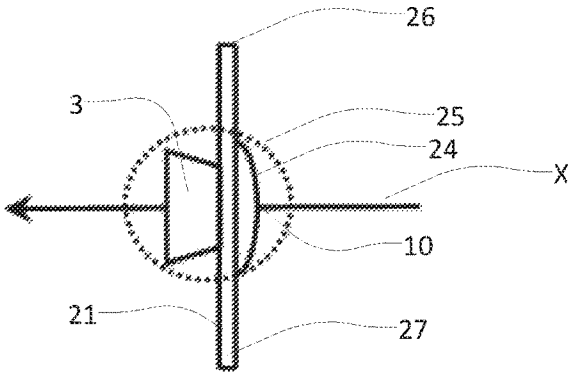

In another embodiment illustrated in FIG. 4B the construction is similar as explained in relation to Figure A.2 Here a single protrusion 24 is provided which extends substantially opposite to the abutment 3 of the plate structure 21. The protrusion 24 does only cover a part of the length of the plate structure 21, and in the embodiment illustrated, the protrusion 24 is substantially centered in a body portion 25 of the plate structure 21. The central arrangement are in line with the embodiment described in relation to FIG. 4A, and the details and effects thereof are considered equal thereto.

Figure 4C:
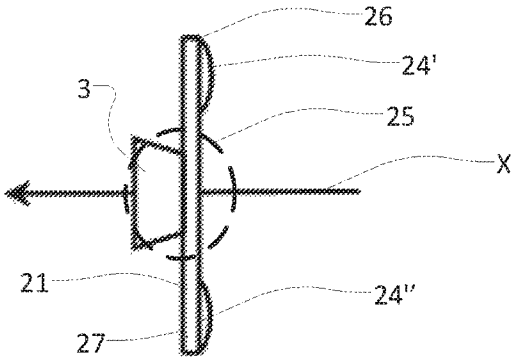
Figure 4D:
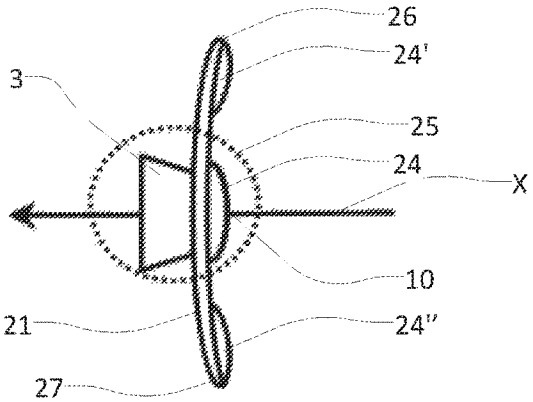
Figure 4E:
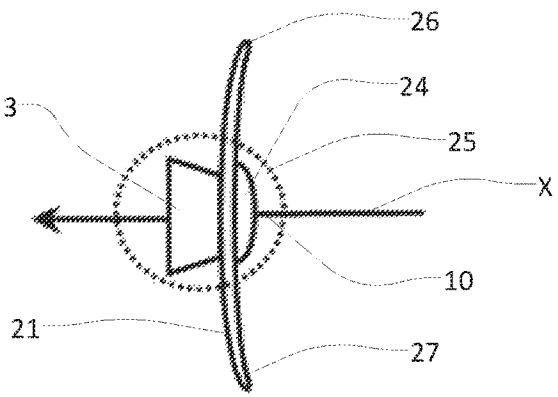

In another embodiment, illustrated in FIG. 4E a single protrusion 24 is similarly integrated into the plate structure 21. Here, the plate structure 21 is configured with a concave shape, and with a protrusion 24 substantially centered in a body portion 25 of the plate structure 21. As previously described the body portion on a first side (front side) comprises the abutment 3 having a center along an axis X substantially defining a middle of the plate structure 21 taken from the top 26 to the bottom 27 of the plate structure 2. On the back side of the concave shaped plate structure 2, the protrusion 24 is configured substantially opposite the abutment 3 and substantially has a center corresponding to the center point of the abutment 3. Accordingly, the protrusion 24 and abutment 3 share a common center axis X. The concave shaped of the plate structure 21 allows for efficient adhesive connection to the skin of a user in at least two points (i.e. at the top 26 and bottom 27), while ensuring an efficient vibration transfer due to the integrated protrusion 2*a*4.

Referring now to FIG. 4C the plate structure 2 is configured with two protrusions 4', 4". A first protrusion 4' is arranged substantially in the top 26 of the plate structure 2, and a second protrusion 4" is arranged in a bottom part 27 of the plate structure. The two protrusions 4, 4' ensures that at least two "contact points" with the skin is present when the plate structure is mounted to the skin of a user. This allows for at least a vibration transfer at two points of the plate structure 2, ensuring that the plate structure 21 is providing an efficient two point vibration transfer to the skull bone. It should be noted that the two protrusions 24', 24" is arranged substantially in opposite ends of each other to ensure that the force distribution along the length of the plate structure 21, is equal. In this way, it is ensured that the plate structure 21, does not easily detach from the skin, due to a force "dragging" the plate structure 21 off the skin of a user.

Referring now to FIG. 4D, another embodiment of the plate structure 21 with more than one protrusion is illustrated. Here, the plate structure 21 comprises three protrusions 24, 24', 24", wherein a first protrusion 24' is arranged in the top 26 of the plate structure 21, a second protrusion 24' is arranged in the bottom 27 of the plate structure 21, and a third protrusion 24" is arranged in the body portion 25 of the plate structure 2. Accordingly, the plate structure 21 is configured so that the three protrusions 24, 24', 24" ensures three contact points to the skin, where an efficient and continuous vibrations transfer takes place even though other parts of the plate structure 2 loosens from the skin.

It should be noted that the protrusions 24, 24', 24" described herein is made from a substantially rigid material, which ensures that vibrations can be transferred directly to the bone structure. By providing these one or more protrusions, an improved vibration transfer is achieved, due to the close contact points at one or more places of the skin. In cases, where no protrusion is present in the connector plate (as is the case of many known non-surgical bone conductive devices), an efficient vibration transfer cannot be ensured at all time at a single point, since the plate structure distributes the vibrational energy along the length of the plate structure. Accordingly, by providing these "single contact protrusions" as described above it is ensured that a vibration will always be transferred in at least the point of the protrusions. Specially, the embodiment described in relation to FIGS. 4A, 4B, 1G and 4D and 4E, the protrusion is optimally arranged in that at least one protrusion is arranged substantially with a center point on the plate structure 21 corresponding to the center point of the abutment 3, which ensures the shortest path for transmission of vibrations.

Furthermore, it should be noted that the construction of the plate structure described in all embodiments herein are optimal in view of a left/right placement of the bone conduction hearing system to the head of a user. As is clearly seen from the embodiments, the plate structure is substantially symmetrical along a longitudinal line going through the plate structure, which ensures that the device is left/right independent and that the device can be placed on both the right and left side of the head. Thus, the plate structure construction avoids the need for a left sided and a right sided device.

As apparent for a skilled person, the above described embodiments of a plate structure 21, is also optimized in design in view of for the force contribution applied to the plate structure 21, when arranged on the skin of a user. Accordingly, the protrusion described above, are integrated into the plate structure 21 in such manner that the center of mass in relation to the mass of the sound processor being connected to the abutment 3 is optimized. Accordingly, the protrusion is integrated into the plate structure 21, so that the torque from the weight of the sound processor is kept in a stable position.

The design of the plate structure has in an embodiment been optimized even further in view of providing a sufficient leverage and support of the weight of the bone conductive device comprising the sound processor. Furthermore, considerations have been given by the inventors to allow a design, which improves the breathability of the skin of the user, when the plate structure is attached thereto. Additional considerations are given, as previously mention to a symmetrical design, which allows a left/right independent plate structure, and an openness of the plate structure which not only improves the breathability but also allow for mounting of the plate structure in the substantially hairless area behind the ear of the user.

Figure 5B:
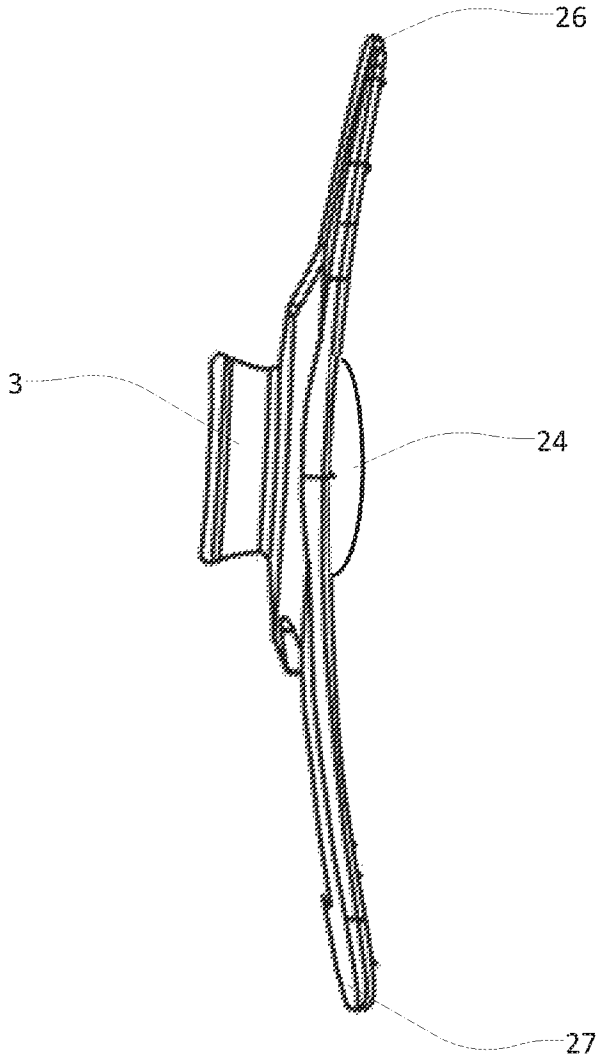
Figure 5A:
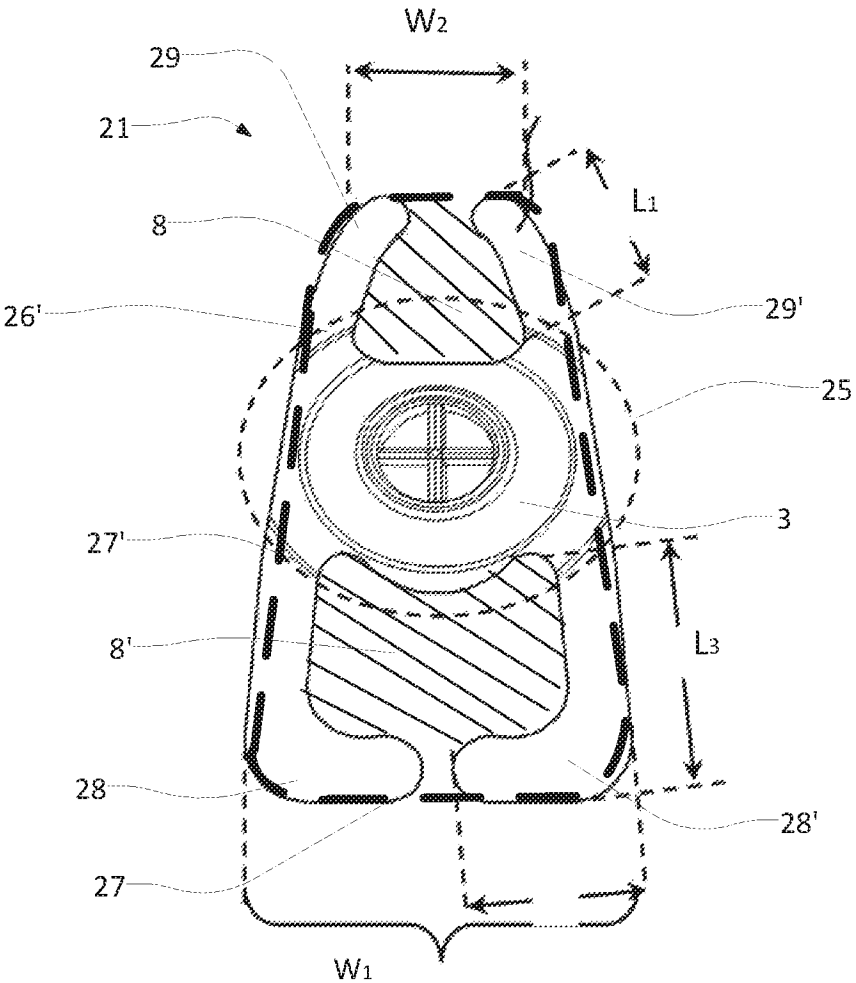

Accordingly, the plate structure 21 has in an embodiment of the disclosure illustrated in FIGS. 5A and 5B been designed as a substantially open profile. This means that the surface area of the connector plate has been provided with "open areas" of the surface structure. The open areas are substantially defined as a space 8, 8' formed between one or more legs 28, 28', 29, 29', which extend form the body portion 25 of the plate structure 21. Accordingly, in the embodiment of FIGS. 5A and 5B, the plate structure 21 comprises a body portion 25, from which a plurality of legs 28, 28', 29, 29' extend. As illustrated the body portion 25 comprises the abutment 3 configured to receive the fixture of the sound processor. From a bottom part 27' of the body portion 25 two leg shaped extensions 28, 28' (denoted as bottom legs) are extending a length $L_3$ to form the bottom 27 of the plate structure 21. Similarly, at a top part 26' of the body portion 25 two leg shaped extensions 29, 29' (denoted as top legs) extends a length $L_1$ to form the top of the plate structure. Accordingly, the length of the plate structure 21 is given between a bottom point of the extension $L_3$ to a top point of the extension $L_1$. In order to provide a sufficient leverage support for the sound processor, the bottom legs 28, 28' are designed such that a width $W_1$ defined by the combined width of the bottom legs 28, 28' are wider than a width $W_2$ defined by the combined width of the top legs 29, 29'. This creates a substantially "triangular shaped" plate structure 21, which allow the plate structure to fit to the hairless area behind the ear of a user, while providing a sufficient leverage for the sound processor. Furthermore, the construction of the plate structure as illustrated in FIG. 5A allows a more adaptive fit to the user of the bone conductive device, in that the "open profile" in the form of openings (i.e. spaces formed between the legs) 8, 8' provided between the top legs 28, 28' and bottom legs 29, 29' allows the user to fit the device to the skin, and also allows the skin to breathe. As illustrated in FIG. 5A, by the dotted line, the plate structure is on the back side provided with an adhesive pad, which covers the entire plate structure 21 including the spaces. The skin can with this construction "breathe" trough the adhesive pad, via the openings (i.e. spaces) provided between the two leg extensions.

In addition, the weight of the sound processor is distributed on the two edges of the bottom 28, 28' and top legs 29, 29' with a distance from each other, resulting in that the peeling force gets lowered at each point, comparing to only one edge. The bottom legs 28, 28' are supporting (i.e. working as leverage) the sound processor in both horizontal and vertical direction, which ensures that the leverage is disturbed onto a larger area on the plate structure. As seen of FIG. 5B, which is a side view of the connector plate of FIG. 5A, the plate structure 21 is on the front side 22 configured with the abutment 3 and on the back side 23 configured with a substantially concave shape and the protrusion 24. It should be noted that the protrusion is provided in a similar manner as described in relation to any one of the other figures.

Figure 6B:
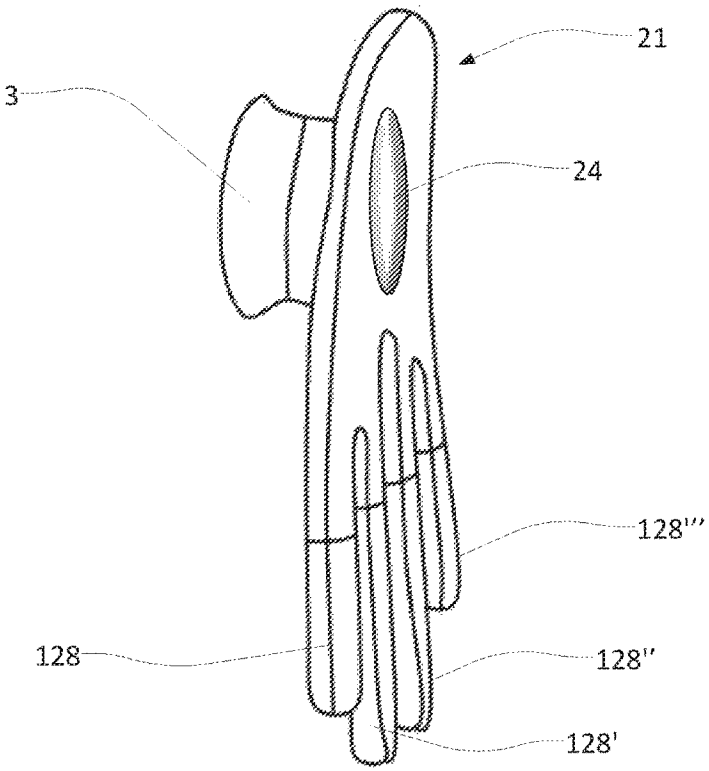
FIGS. 6A to 6B illustrates an embodiment of the plate structure, wherein the plate structure comprises legs forming a substantially hand shaped plate structure.
Figure 6A:
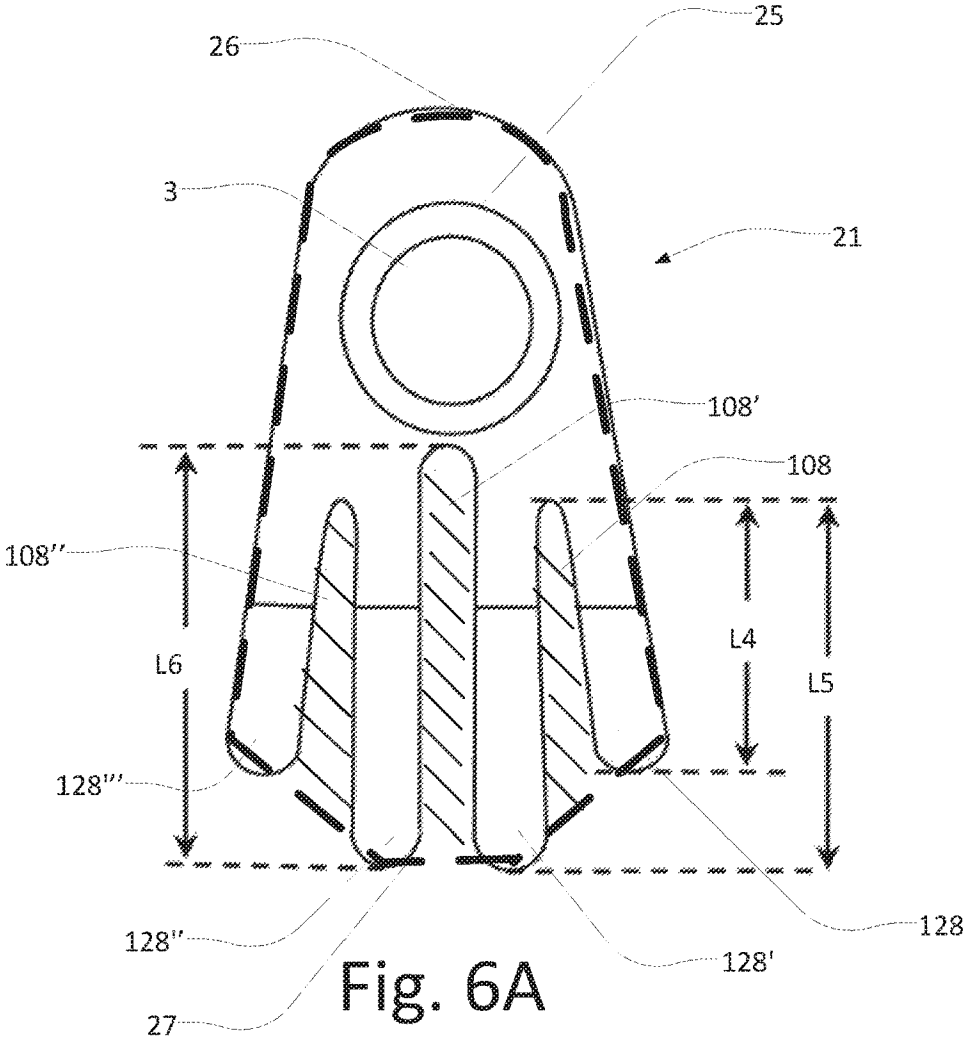

Another type of "open profile" plate structure 21, where the protrusion is implicitly understood to form part of the plate structure as described herein is illustrated in FIGS. 6A and 6B, where FIG. 6B is a side view of the plate structure illustrated in FIG. 6A. As illustrated in FIG. 6A, the plate structure 2 comprises in this embodiment a body portion 25, which is arranged substantially in a top part 26 of the plate 2 structure. From the body portion 25, a plurality of legs 128, 128', 128", 128'" extends a length L downwards from the body portion 25 and defines a bottom portion 27 of the plate structure 21. As illustrated in FIG. 6B, the plate structure 21 is in this embodiment substantially shaped as a hand, where the legs 128, 128', 128", 128'" defines the fingers of the hand and the body portion 25 comprising the abutment 3 is the "palm" of the hand. The fingers (i.e the legs) extend in different lengths $L_4$, $L_5$, $L_6$ from the palm, which allow flexibility of the plate structure, in the form of the flexible legs (i.e. fingers), which are made from a flexibility which allows the legs to bend to fit the contours of the head of the user, where the plate structure 21 is placed. Furthermore, as described in the previous embodiment, also this construction of a plate structure defines spaces 108, 108', 108" between the fingers, which improves the breathability of the plate structure 2 ensuring that the skin can breathe when the plate structure 21 is mounted to the skin. In addition, the length of the legs 128, 128', 128", 128'" ensures that a sufficient leverage of the sound processor is achieved, when the sound processor is connected to the abutment 3 of the plate structure 2. As described in relation to the previous embodiments, this plate structure construction similarly comprises the integrated protrusion as illustrated in FIG. 6B. Furthermore, as illustrated with the dotted line in FIG. 6A, the plate structure comprises at the backside thereof an adhesive pad, which covers the entire plate structure, including the spaces between the fingers. In this way the skin can breathe through the adhesive pad via the spaces.

A thickness of the plate structure around or in vicinity of the abutment is thicker than the fingers of the plate structure. Thereby, the plate structure provides support of the abutment while providing a flexibility in the fingers for supporting individual positioning and shape ability around an area of the skin of a user.

The thickness of the plate structure may vary in order to improve the flexibility of the plate structure and for obtaining an improved adaptation to the skin curvature of the user. The thickness may gradually decrease in a radially direction from the abutment 3.

The plate structure 21 may comprise a first area which includes the abutment 3, and the plate structure 21 may include a second area which does not include the abutment 3. The first area may extend radially away from the abutment 3 having a radius or a width of 2 to 10 mm, and the second area may extend radially away from the abutment 3 having a radius or a width of 5 to 20 mm. The thickness of the plate structure 21 within the first area may be constant, and the thickness of the plate structure 21 within the second area may decrease gradually and radially away from the abutment 3.

Figure 7B:
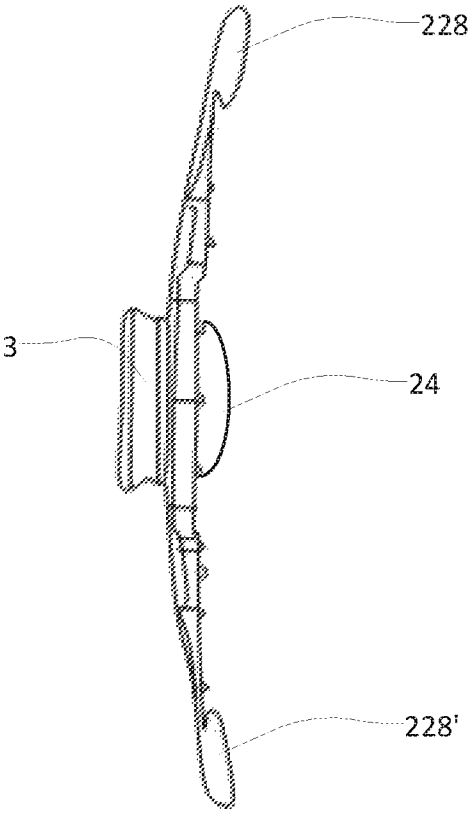
Figure 7A:
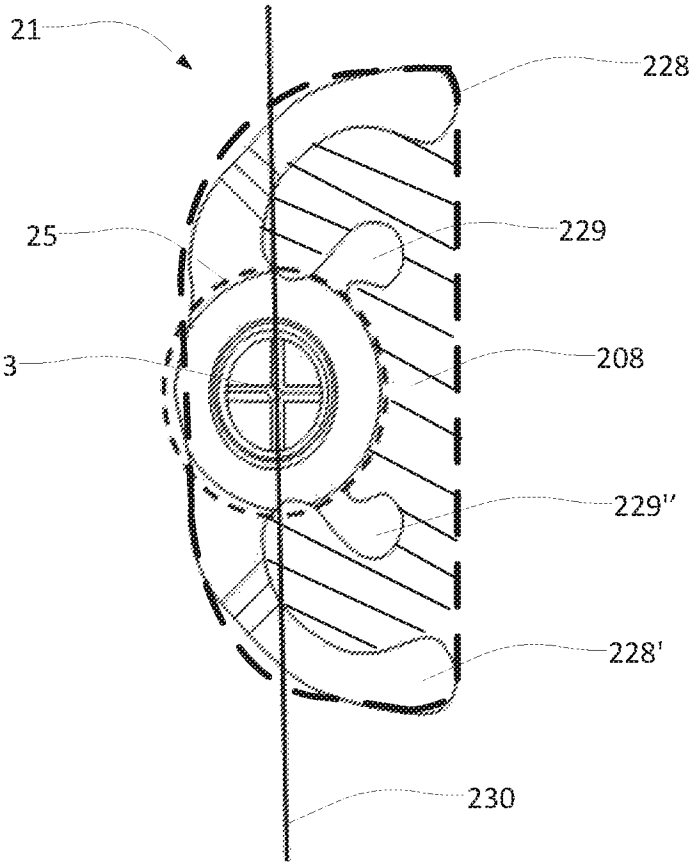

Another embodiment of an "open profile" plate structure 2 is illustrated in FIG. 7A and FIG. 7B, where FIG. 7B is a side view of the plate structure 2 illustrated in FIG. 7A. As seen this plate structure 2 also comprises a set of arms 228, 228', 229, 229' (similar to the legs of the two previous embodiments). In line with the previous described embodiments the arms 228, 228', 229, 229' extends a distance from the body portion 25 of the plate structure 21. In this embodiment a first set of arms 228, 228' are extending from at least one side of a longitudinal center axis 230 of the body portion 25, in a manner where the arms 228, 228' is shaped such that the extension thereof crosses the longitudinal center axis 230. Accordingly, the arms 228, 228' has a curved shape, and is connected to the body portion 25 at one end, from which end the curve of the arms 228, 228' is such that the arms cross the longitudinal center axis 230. On the opposite site of the longitudinal center axis 230, a second set of arms 229, 229' which a slightly smaller than the first set of arms extends a distance radially from the body portion 25. The smaller arms 229, 229' is slightly curved and are distanced from the first set of arms 228, 228' so that a space 208 is formed between the two set of arms. As previously describes this space, and the remaining of the plate structure is covered by an adhesive pad (as illustrated by the dotted line) on the back side thereof, so to allow breathability when the adhesive pad ensures that the plate structure can be mounted to the head. Thus, it should be understood, that it is the back side, substantially illustrated in FIG. 7B, that is covered by the adhesive pad (preferably without covering the protrusion, as has previously been elaborated on).

Figure 8A:
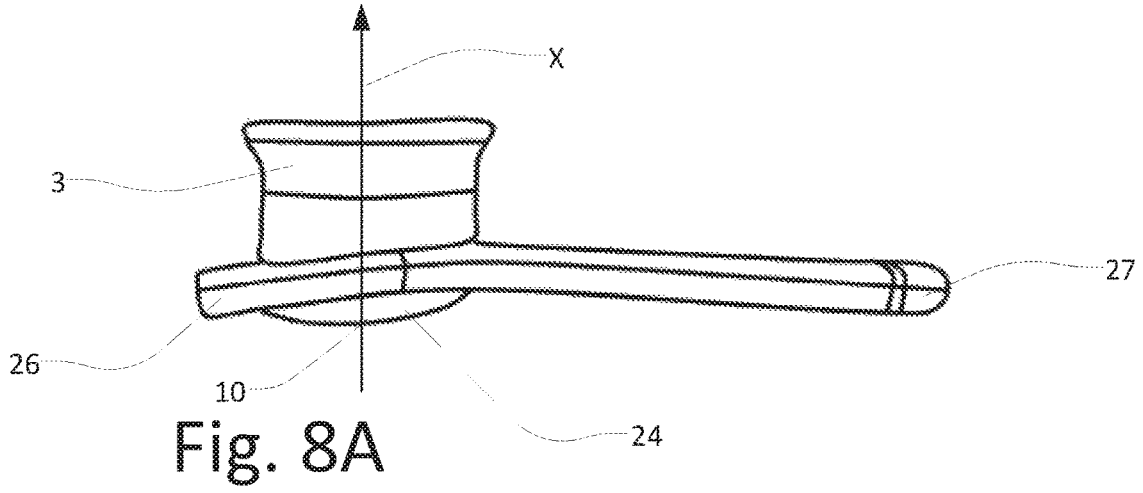
FIGS. 8A, 8B and 8C illustrates a plate structure of the substantially closed type having a closed bottom structure, where
Figure 8B:
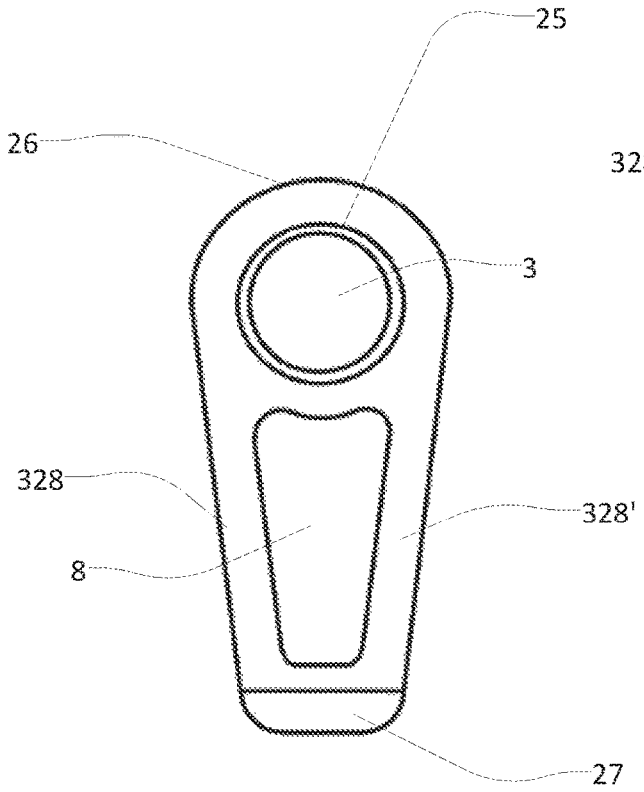
Figure 8C:
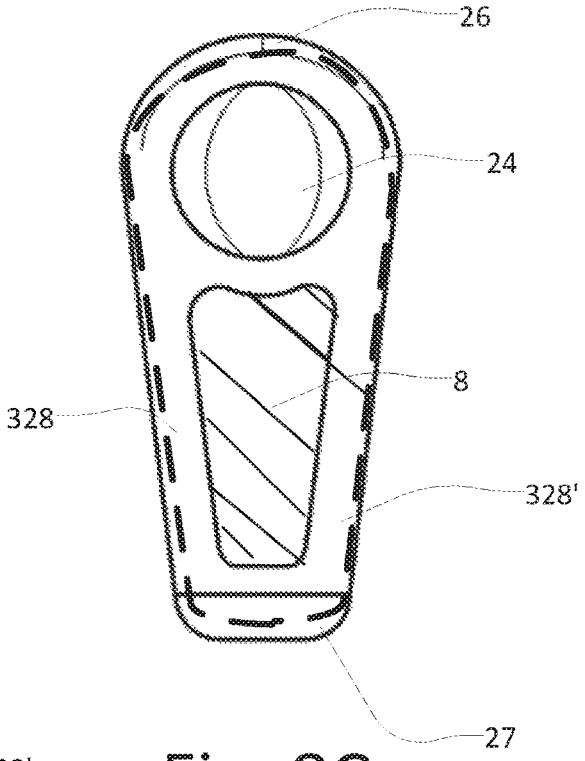

Referring now to FIGS. 8A, 8B and 8C an embodiment of the plate structure 21 is illustrated. As illustrated the plate structure 2 is configured as a "partly open profile", where an opening (i.e. a space) 8 is provided in a bottom part 27 of the plate structure 21. Thus opening 8 is contrary to the previously described embodiments "closed" in that the material of the plate structure 21 encircles the opening. In other words, the legs 328, 328' which extends from the body portion 25 is combined in the bottom portion, so as to create an opening in the plate structure. In line with the previous described embodiments, the plate structure 21 comprises on a first side the abutment 3 and on the second opposing site the protrusion 24. As seen in FIG. 8A, which is a side with of the plate structure 21, the abutment 3 and the protrusion 24 is arranged substantially above each other so that a center point of the abutment 3 and a center point of the protrusion 24 is centered around the same axis X. Accordingly, the top point 10 of the protrusion 24 is substantially arranged in the middle of the abutment 3, ensuring an efficient vibration transfer.

Figure 9A:
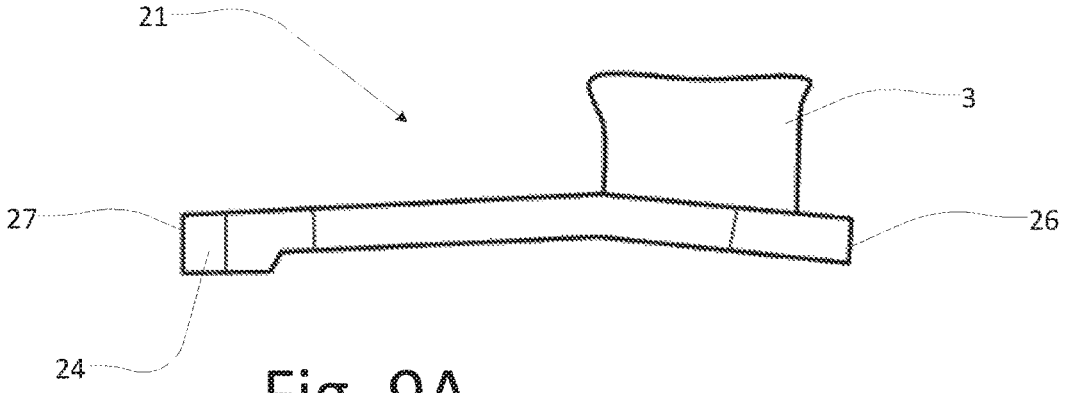
Figure 9C:
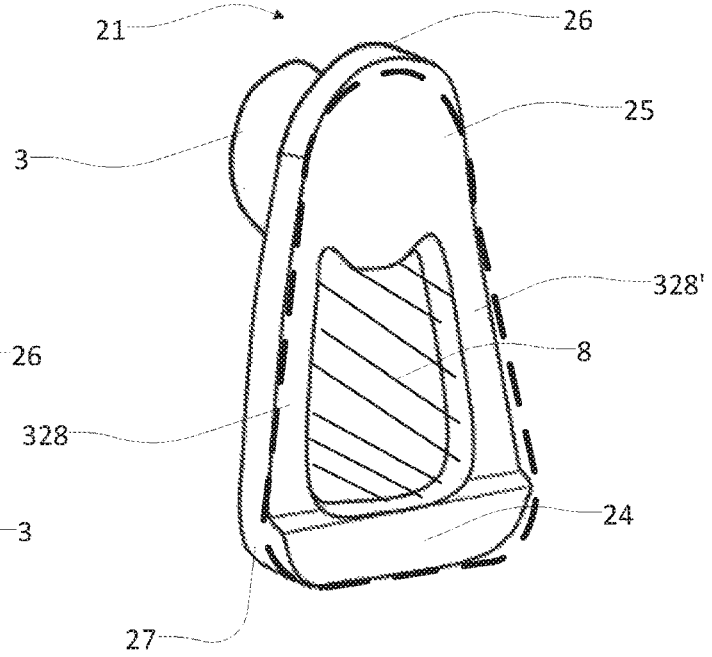
Figure 9B:
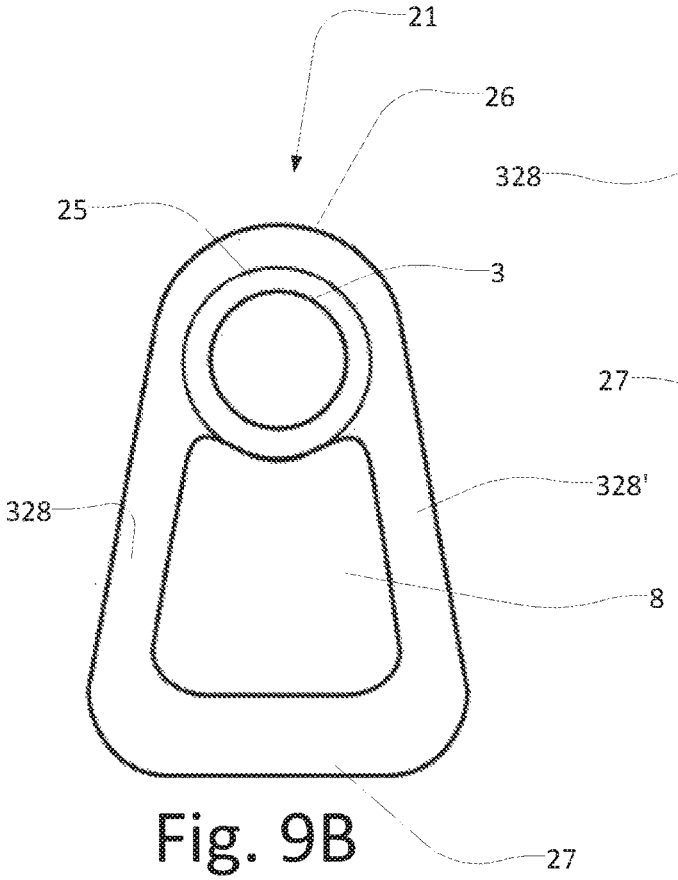

In another similar embodiment illustrated in FIGS. 9A, 9B and 9C, the plate structure 2 is configured with one protrusion 24', which are arranged in the bottom part 27 of the plate structure 2. Accordingly, in this embodiment, the protrusion 24' and the abutment 3 is not centered together in the body portion 25. However, it should be noted that a protrusion could be arranged opposite to the abutment as described in the previous embodiments.

Figure 10:
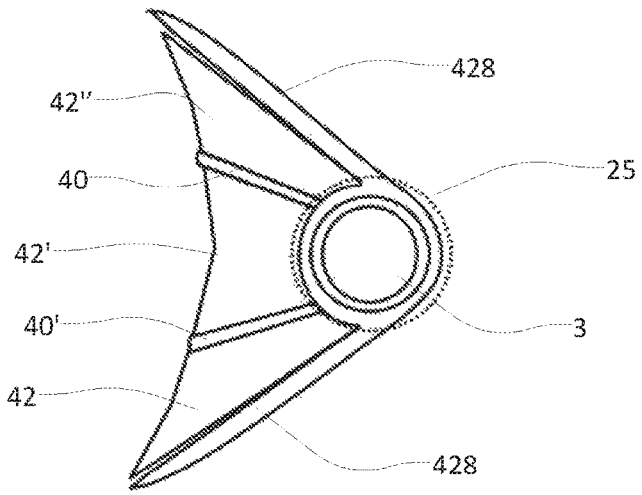
FIG. 10 illustrates a boomerang shaped plate structure having an abutment and a protrusion integrated therein.

Referring now to FIG. 10 a further embodiment of the plate structure 21 is illustrated. In this and the following embodiments, the plate structure 2 is substantially boomerang shaped, with two wings 428, 428', which extends from a body portion 25. In the embodiment shown in FIG. 10, it should be understood that on the first side the abutment 3 is arranged and configured to receive a fixture of a sound processor, whereas on the opposite back side (not shown) the protrusion as previously described is arranged to abut the skin of a user. The front side 22 of the plate structure 21 in FIG. 10 is configured with a variation in the thickness of the wings 428, 428'. As illustrated three thinner parts 42, 42', 42" is configured in between at least two rigid structures 40, 40'. The combination of three thin parts 42, 42', 42" with a set of rigid structure, allows flexibility and bendability of the plate structure 2.

Figure 11:
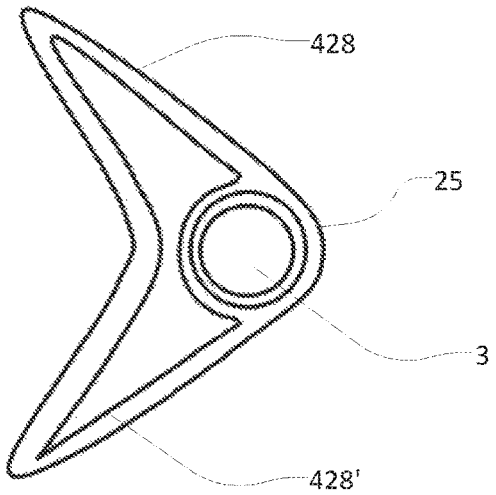
FIG. 11 illustrates another boomerang shaped plate structure.
Figure 12A:
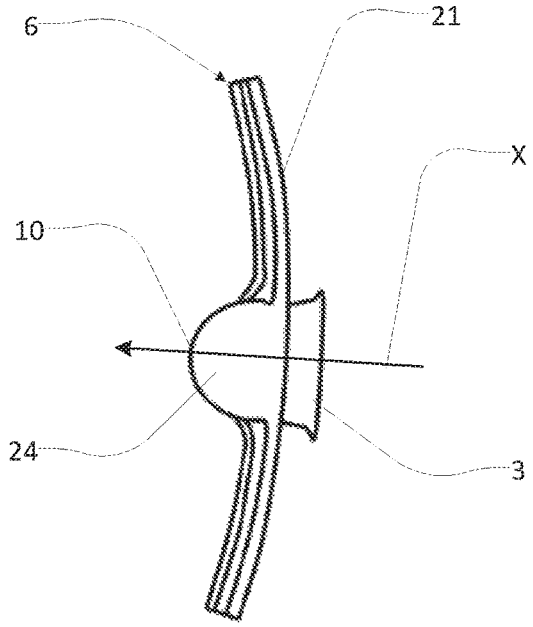
FIGS. 12A and 12B illustrates a back view and a side view of an embodiment of the boomerang shaped plate structure of FIG. 11, wherein the protrusion is at a top point thereof is not covered by the adhesive pad.
Figure 12B:
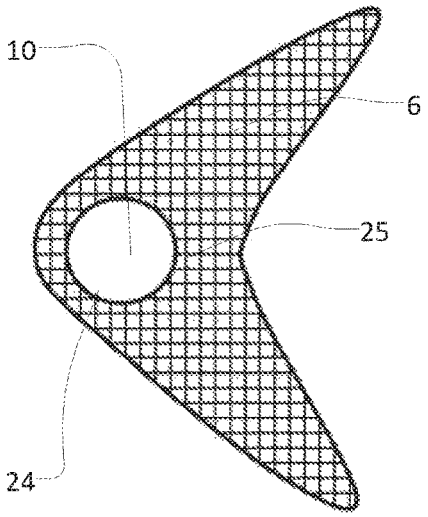

A similar configuration of the plate structure is illustrated in FIGS. 11, 12A and 12B. Here the plate structure is similarly boomerang shaped with two wings 428, 428'. As seen, with reference to at least FIG. 12A, the plate structure 21, comprises an abutment 3 on a first side, and a protrusion 24 on a second side. In line with the embodiment described in relation to at least FIG. 3A, the protrusion 24, is not covered by an adhesive pad 6 on a top point 10 thereof. This ensures a more direct vibration transfer, since the vibrations does not need to go through several layers of material prior to reaching the skin of a user. This is further illustrated in FIG. 12B, where it is seen that the protrusion 24, is not covered by any structured layer, generally illustrated as an adhesive layer of the adhesive pad 6, generally marked by the structured surface. Furthermore, it is noted that the protrusion and abutment share a common center point through axis X allowing the most direct vibration transfer.

Figure 13A:
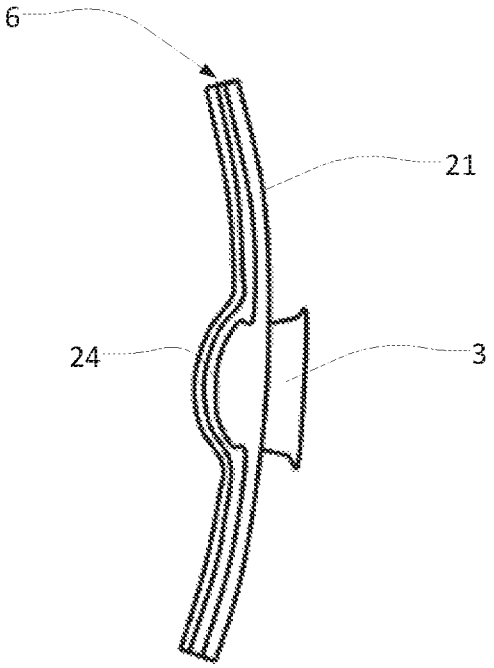
FIGS. 13A and 13B illustrates a side view and a back view, respectively, of an embodiment of the boomerang shaped plate structure of FIG. 11, wherein the protrusion is covered at a top point thereof by the adhesive pad.
Figure 13B:
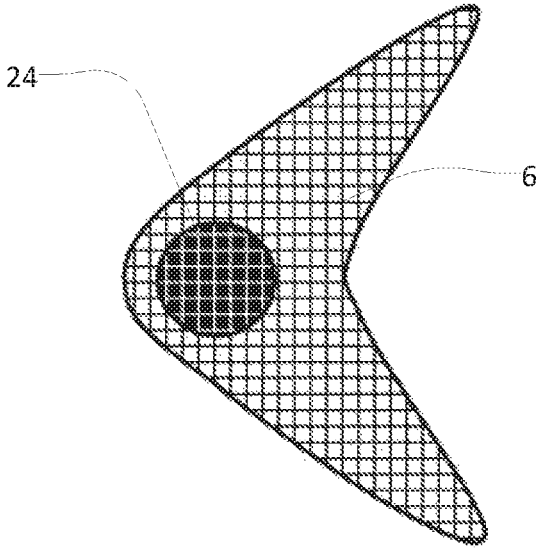

In a similar embodiment illustrated in FIGS. 13A and 13B, the protrusion 24 is covered by the adhesive layer of the adhesive pad 6. It should be noted that the features described in relation to the embodiment of FIGS. 11, 12A and 12B similarly applies for the embodiment described in FIGS. 13A and 13B, except for the arrangement of the adhesive layer, which in the embodiment of FIGS. 13A and 13B covers the protrusion 24.

It should generally be noted, that for at least the boomerang shaped embodiments just described, the plate structure is also left/right independent, and the only action needed for placing the boomerang shaped plate structure that needs to be taken is to merely rotate the plate structure such that the wings extends away from backside of the ear in the hairless area behind the ear. Accordingly, a boomerang shaped plate structure according to the embodiment described herein that is arranged on the left side of the head, can be directly mounted on the right side, by merely rotating the plate structure.

In addition, the embodiment described in relation to FIGS. 7A and 7B similarly fits onto the right and left ear in a rotational manner.

The remaining embodiments, described in e.g. FIGS. 8A, 8B, 9A, 9B, 6A, 6B, 5A, 5B and 2A etc. needs not to be rotated when mounting to the left and right ear. Here the symmetry ensures that the device fits on both ears.

Thus, from the above descriptions of the embodiments, it should be understood that different configuration of the layer construction of the adhesive pad and coverage on the plate structure can be used. Therefore, in the following, the construction of the adhesive pad in relation to the plate structure will be explained in more detail, and each of the described configuration could be combined with any of the previous described embodiments of the plate structure.

Figure 14:
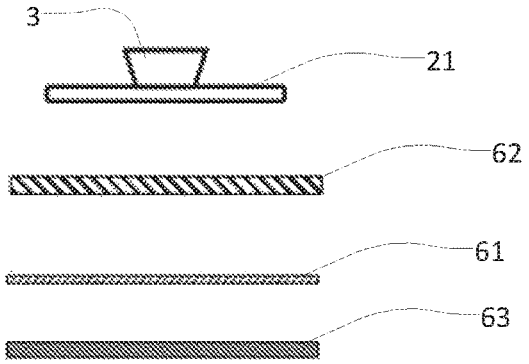
FIG. 14 illustrates an exploded view of the plate structure and the adhesive pad, wherein the adhesive pad comprises three layers.

Referring initially to FIG. 14, an exploded view of the plate structure with the adhesive pad 6 is illustrated. The adhesive pad 6 comprise an adhesive layer 61, which is attached to the plate structure 21, via a first carrier layer 62 and/or a first 62 and second carrier layer 63. The plate structure 21 and the adhesive pad 6 together forms the connector. It should be noted that the following embodiments does not directly illustrate the protrusion 24, which is integrated into the plate structure 21, but it should be contemplated that such protrusions is integrated in a manner as previously described. Also a liner for protecting the adhesive pad could be considered for all of these embodiments.

Figure 14A:
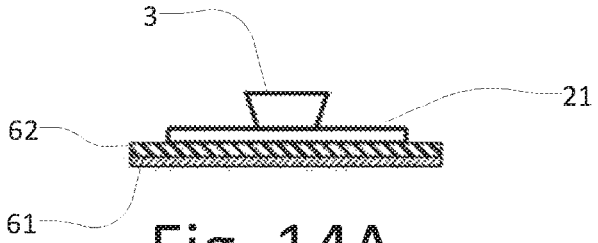
FIGS. 14A to 14H illustrates different embodiments of the plate structure with the adhesive pad according to FIG. 14, where the layers are arranged in different ways.
Figure 14E:
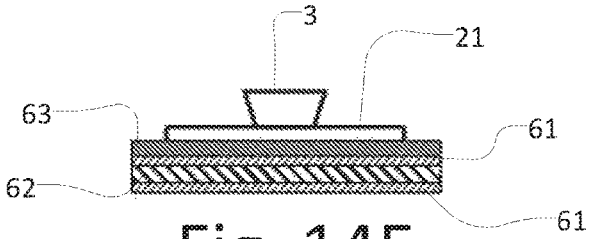
Figure 14B:
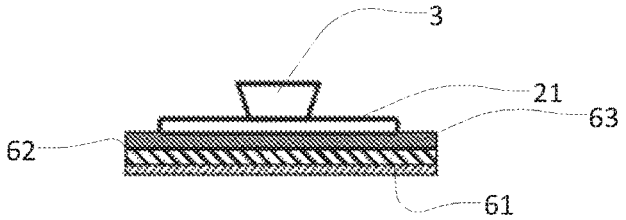
Figure 14F:
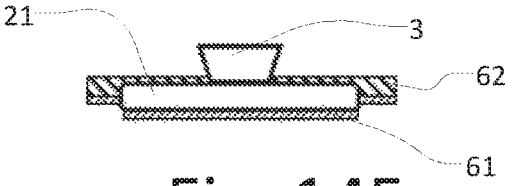

Referring initially to FIGS. 14A, 14B and 14E, embodiments wherein the plate structure is arranged on top of one of the first or second carrier layer and the adhesive layer is illustrated. In these embodiments it should be understood that the protrusion is covered by the adhesive. However, a skilled person would from the previous discussion understood that embodiments, where the protrusion is not covered by the adhesive is also contemplated with the constructions described here. FIG. 14A illustrates how the plate structure 21 may comprise a first carrier layer 62 and an adhesive layer 61. In the embodiment of FIG. 14E, the plate structure 21 comprises an adhesive pad 6 consisting of four layers, a carrier layer 63 mounted to the second side 23 of the plate structure, a first adhesive layer 61, and a second carrier layer 16 and a further second adhesive layer 61. The four-layer construction of the adhesive pad assembly according to the embodiment of FIG. 14E ensures a more stable connector plate, which is able to support the weight of the sound processor (not shown) in an efficient manner. Similarly FIG. 14B illustrates an embodiment, wherein the plate structure 21 is connected to a first carrier layer 62 and a subsequent second carrier layer 63. Accordingly, in the embodiment of FIG. 14B no adhesive layer is arranged between the first and second carrier layer. Instead, the adhesive layer 61 is mounted onto the carrier layer 62. The construction of a plate structure with two carrier layers 62, 63 of the adhesive pad 6, ensures a more stable adhesive pad which ensures an efficient support of the sound processor (not shown).

Referring now to FIGS. 14C, 14G, 14F and 14H, these embodiments generally illustrates how the plate structure 21 may form an integrated part of at least one of the carrier layers 62, 63. As illustrated in the Figures, the plate structure 21 is generally integrated into carrier layer 62 in a manner in which the plate structure is substantially lowered into the carrier layer 62. This ensures that the surface of the plate structure 21 is substantially hidden in the carrier layer 1662 which allows for a more discrete surface. That is, the carrier layer 62, may be formed as a "shell-looking" surface, which may be provided in colors, skin structure etc., to provide a more discreet look when a user is wearing the connector.

Figure 14C:
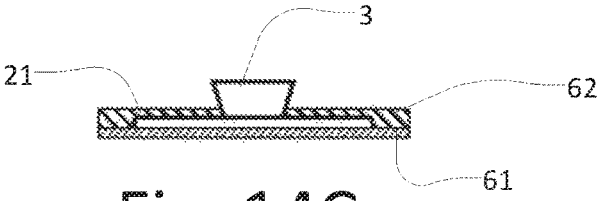
Figure 14G:
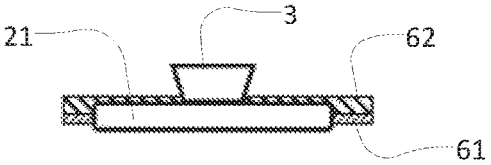
Figure 14D:
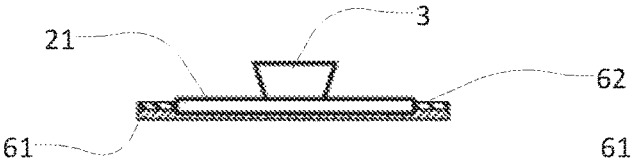

As illustrated in FIGS. 14C and 14D, the plate structure 21 is in an embodiment configured such that the carrier layer 62 converse the first side (i.e. the front side) of the plate structure 21 allowing only the abutment 3 to be visible. Furthermore, the plate structure may in these embodiments be configured such that the back side (i.e. the second side) protrudes from the carrier layer 62 on the opposite side of the abutment 3 (not shown).

Figure 14H:
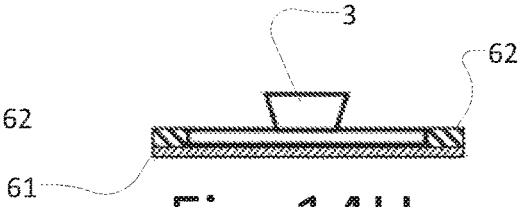

In the embodiments of FIGS. 14C, 14D and 14H, the plate structure does not extent through the entire adhesive pad 6, but is merely integrated into the carrier layer 62.

It should be noted that for all the embodiments described herein the adhesive pad may comprise a carrier of a non-woven nylon liner and an acrylic based adhesive. This combination has been provided in view of improving the breathability of the adhesive pad when the connector plate is connected to the skin of a user. Furthermore, it should be noted that the adhesive pad is configured such that it may be bend and shaped, so as to allow a tight fit to the skin of a user. In addition, the adhesive pad may comprise a liner (made from e.g. a silicone based paper), which forms a protective layer to the adhesive pad, that may be removed before mounting the connector to the skin of a user. Furthermore, it should be noted that the carriers are substantially made from a polyester and that the adhesive is based on an acrylic composition.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A bone conductive hearing system including a connector configured to be attached to a part of the skin of the skull of a hearing impaired person, said connector comprising a plate structure including:

a first side provided with an abutment protruding from the first side and being configured to be detachably attached to a sound processor of a bone conducting system; and a second side opposing said first side provided with a protrusion, wherein said protrusion is configured to protrude from a surface of the second side in a direction away from said abutment, wherein said protrusion is configured to abut the skin of a skull when the connector is attached to the skin, and wherein said plate structure comprises a top part and a bottom part defining a substantially longitudinal direction of said plate structure, wherein said protrusion and said abutment are arranged centrally with respect to each other in said top part of said plate structure so as to define said body portion, and wherein a first set of one or more legs extends from said body portion towards said bottom, wherein the extension of said first set of said one of more legs defines said bottom part of said plate structure.

2. A bone conductive hearing system according to claim 1, wherein said plate structure is configured to connect with an adhesive pad, said adhesive pad configured to cover said second side and configured to allow said plate structure to be adhesively attached to the skin of a user.

3. A bone conductive hearing system according to claim 1, wherein the protrusion is formed as an integrated part of the plate structure.

4. A bone conductive hearing system according to claim 1, wherein said protrusion is centrally arranged with respect to said abutment, wherein said protrusion and said abutment together defines a body portion of said plate structure.

5. A bone conductive hearing system according to claim 1, wherein the adhesive pad comprises one or more carrier layers and at least one adhesive layer, said one or more carrier layers being provided with an opening wherein the protrusion extends through the opening.

6. A bone conductive hearing system according to claim 1, wherein at least one of said abutment and/or said protrusion is arranged in said body portion of the plate structure, said body portion being defined as a center point of the plate structure which is substantially in the middle of the plate structure when measured from a top part to a bottom part of the plate structure, wherein the top and bottom parts are defined along a longitudinal axis of the plate structure.

7. A bone conductive hearing system A bone conductive hearing system including a connector configured to be attached to a part of the skin of the skull of a hearing impaired person, said connector comprising a plate structure including:

a first side provided with an abutment protruding from the first side and being configured to be detachably attached to a sound processor of a bone conducting system;

a second side opposing said first side provided with a protrusion, and, wherein said protrusion is configured to protrude from a surface of the second side in a direction away from said abutment, wherein said protrusion is configured to abut the skin of a skull when the connector is attached to the skin, wherein said protrusion is centrally arranged with respect to said abutment, wherein said protrusion and said abutment together defines a body portion of said plate structure, and wherein said plate structure comprises two or more protrusions, wherein a first protrusion is configured as said centrally arranged protrusion with respect to said abutment and at least a second protrusion is arranged in a position being laterally displaced with respect to the abutment.

8. A bone conductive hearing system including a connector configured to be attached to a part of the skin of the skull of a hearing impaired person, said connector comprising a plate structure including:

a first side provided with an abutment protruding from the first side and being configured to be detachably attached to a sound processor of a bone conducting system; and a second side opposing said first side provided with a protrusion, wherein said protrusion is configured to protrude from a surface of the second side in a direction away from said abutment, wherein said protrusion is configured to abut the skin of a skull when the connector is attached to the skin, wherein at least one of said abutment and/or said protrusion is arranged in said body portion of the plate structure, said body portion being defined as a center point of the plate structure which is substantially in the middle of the plate structure when measured from a top part to a bottom part of the plate structure, wherein the top and bottom parts are defined along a longitudinal axis of the plate structure, and wherein one of more legs extends radially outwards from said body portion, wherein at least the abutment is arranged centrally in the body portion.

9. A bone conductive hearing system according to claim 1, wherein the plate structure comprises a second set of legs extends form said body portion in an opposite direction to said first set of legs, wherein the second set of legs is substantially shorter than said first set of legs.

10. A bone conductive hearing system according to claim 1, wherein the one or more legs are configured as a plurality of fingers extending from the body portion.

11. A bone conductive hearing system according to claim 8, wherein said one or more legs extends from said body portion in a manner, whereby a space is formed between said one or more legs, and wherein said space is covered at least by said adhesive pad.

12. A bone conductive hearing system according to claim 8, wherein said one or more legs extending from said body portion are combined in said bottom part of the body portion, so as to form a closed loop forming an opening in said bottom part plate structure, wherein said opening is covered by adhesive pad.

13. A bone conductive hearing system according to claim 1, comprising a sound processor configured to pick up sound from the environment and to convert said sound from the environment into vibrational energy, and a fixture configured to connect with an abutment of a connector, wherein the sound processor is configured to transmit said vibrational energy through the skin of a user via said connector.

14. A bone conductive hearing system according to claim 2, wherein the protrusion is formed as an integrated part of the plate structure.

15. A bone conductive hearing system according to claim 2, wherein said protrusion is centrally arranged with respect to said abutment, wherein said protrusion and said abutment together defines a body portion of said plate structure.

16. A bone conductive hearing system according to claim 3, wherein said protrusion is centrally arranged with respect to said abutment, wherein said protrusion and said abutment together defines a body portion of said plate structure.

17. A bone conductive hearing system according to claim 2, wherein the adhesive pad comprises one or more carrier layers and at least one adhesive layer, said one or more carrier layers being provided with an opening wherein the protrusion extends through the opening.

18. A bone conductive hearing system according to claim 3, wherein the adhesive pad comprises one or more carrier layers and at least one adhesive layer, said one or more carrier layers being provided with an opening wherein the protrusion extends through the opening.

19. A bone conductive hearing system according to claim 4, wherein the adhesive pad comprises one or more carrier layers and at least one adhesive layer, said one or more carrier layers being provided with an opening wherein the protrusion extends through the opening.

* * * * *